US011428404B2

(12) United States Patent
Maduta et al.

(10) Patent No.: US 11,428,404 B2
(45) Date of Patent: Aug. 30, 2022

(54) METHOD AND APPARATUS FOR COMBUSTION OF GASEOUS OR LIQUID FUEL

(71) Applicant: OUTOTEC (FINLAND) OY, Espoo (FI)

(72) Inventors: Robert Maduta, Hemsbach (DE); Michael Ströder, Frankfurt am Main (DE); Andreas Munko, Bad Homburg (DE)

(73) Assignee: OUTOTEC (FINLAND) OY, Espoo (FI)

( * ) Notice: Subject to any disclaimer, the term of this patent is extended or adjusted under 35 U.S.C. 154(b) by 87 days.

(21) Appl. No.: 16/619,995

(22) PCT Filed: Jun. 13, 2017

(86) PCT No.: PCT/EP2017/064412

§ 371 (c)(1),
(2) Date: Dec. 6, 2019

(87) PCT Pub. No.: WO2018/228677

PCT Pub. Date: Dec. 20, 2018

(65) Prior Publication Data

US 2021/0080103 A1 Mar. 18, 2021

(51) Int. Cl.

| | |
|---|---|
| ***F23D 14/24*** | (2006.01) |
| ***F23D 99/00*** | (2010.01) |
| ***F23D 14/22*** | (2006.01) |

(52) U.S. Cl.

CPC ..... *F23D 14/24* (2013.01); *F23D 91/02* (2015.07); *F23C 2900/03005* (2013.01); *F23C 2900/06041* (2013.01)

(58) Field of Classification Search

CPC .. F23C 2900/03005; F23C 2900/06041; F23D 14/22; F23D 14/24; F23D 91/02

See application file for complete search history.

(56) References Cited

U.S. PATENT DOCUMENTS 7,066,728 B2 * 6/2006 Chatel-Pelage ..... F23L 7/007 431/9
7,175,423 B1 * 2/2007 Pisano ..... F23C 6/045 431/10

(Continued)

FOREIGN PATENT DOCUMENTS

DE 102015107360 A1 * 11/2016 ..... F23C 6/04
WO 2010111217 A1 9/2010

(Continued)

OTHER PUBLICATIONS

International Search Report issued by the European Patent Office acting as the International Searching Authority in relation to International Application No. PCT/EP2017/064412 dated Feb. 19, 2018 (3 pages).

(Continued)

*Primary Examiner* — Jorge A Pereiro
*Assistant Examiner* — Logan P Jones
(74) *Attorney, Agent, or Firm* — Robert P. Michal, Esq.; Carter, DeLuca & Farrell LLP

(57) ABSTRACT

A method and apparatus for combustion of fuel in a combustion chamber with a hydraulic diameter D. Fuel and a primary oxidant are introduced via a burner lance into the combustion chamber, having a certain mean velocity u1 at entry, and a secondary oxidant with a mean velocity of u2 is introduced into the combustion chamber. The burner lance has a position p that has a distance Id1I defined as the smallest distance between p and a combustion chamber centerline.

11 Claims, 6 Drawing Sheets

(56) References Cited

U.S. PATENT DOCUMENTS

| | | | | |
|---|---|---|---|---|
| 7,229,281 | B2 * | 6/2007 | Hansen | C04B 7/43 106/758 |
| 8,202,470 | B2 * | 6/2012 | Cain | F27D 21/00 266/44 |
| 9,023,127 | B2 * | 5/2015 | Fredriksson | C22B 1/212 75/330 |
| 2010/0282021 | A1 * | 11/2010 | Grant | C21C 5/5217 75/10.4 |
| 2012/0073261 | A1 * | 3/2012 | Palmer | F23C 7/08 60/39.461 |
| 2016/0201904 | A1 * | 7/2016 | Munko | F27D 99/0033 431/12 |

FOREIGN PATENT DOCUMENTS

| | | | |
|---|---|---|---|
| WO | 2013023116 | A1 | 2/2013 |
| WO | 2015018438 | A1 | 2/2015 |

OTHER PUBLICATIONS

International Preliminary Report on Patentabiity issued by the European Patent Office acting as the International Preliminary Examining Authority in relation to International Application No. PCT/EP2017/064412 dated Aug. 7, 2019 (9 pages).

Written Opinion of the International Searching Authority issued by the European Patent Office acting as the International Searching Authority in relation to International Application No. PCT/EP2017/064412 dated Feb. 19, 2018 (5 pages).

Written Opinion of the International Preliminary Examining Authority issued by the European Patent Office acting as the International Preliminary Examining Authority in relation to International Application No. PCT/EP2017/064412 dated May 16, 2019 (8 pages).

* cited by examiner

Figure 1:
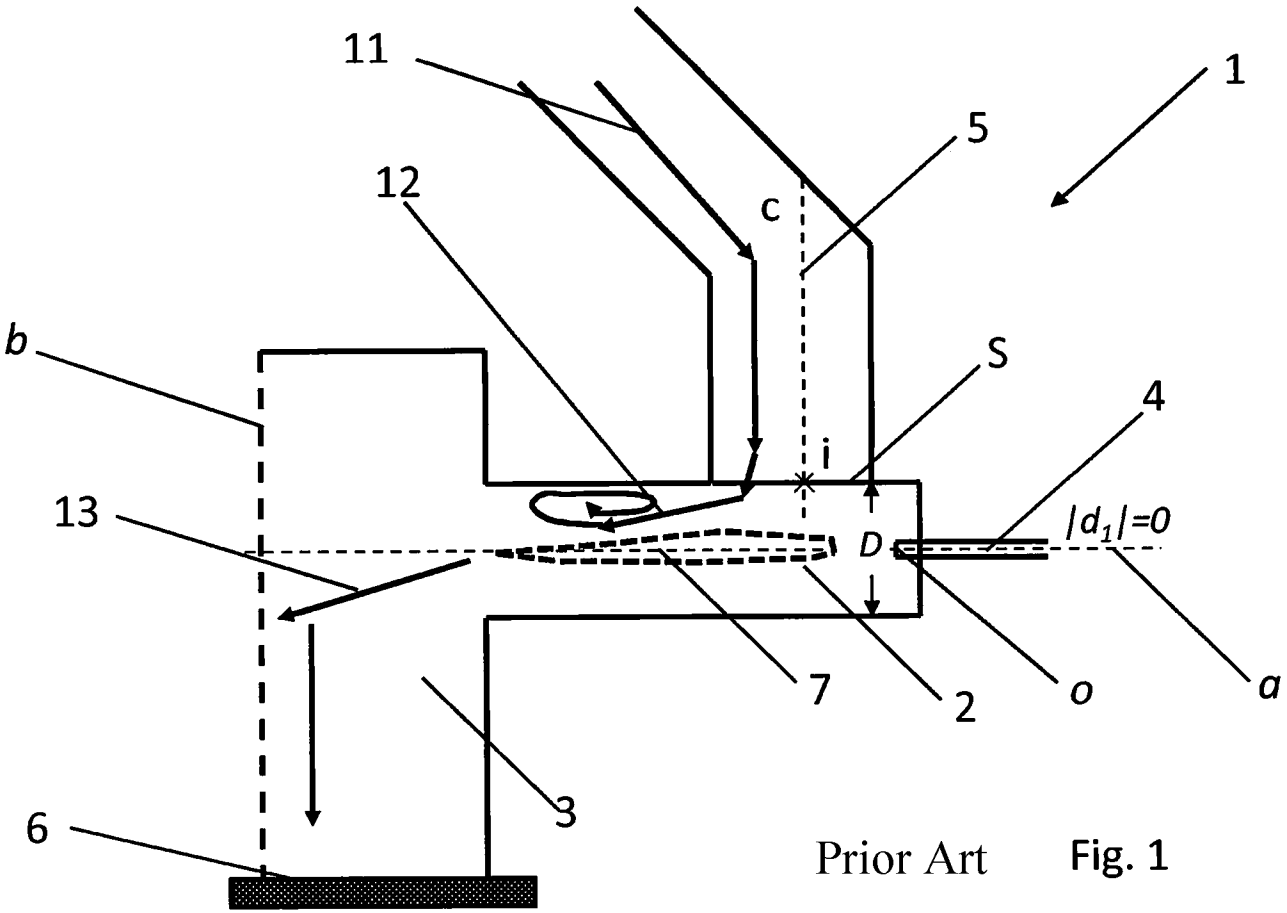

Prior Art Fig. 1

Figure 2:
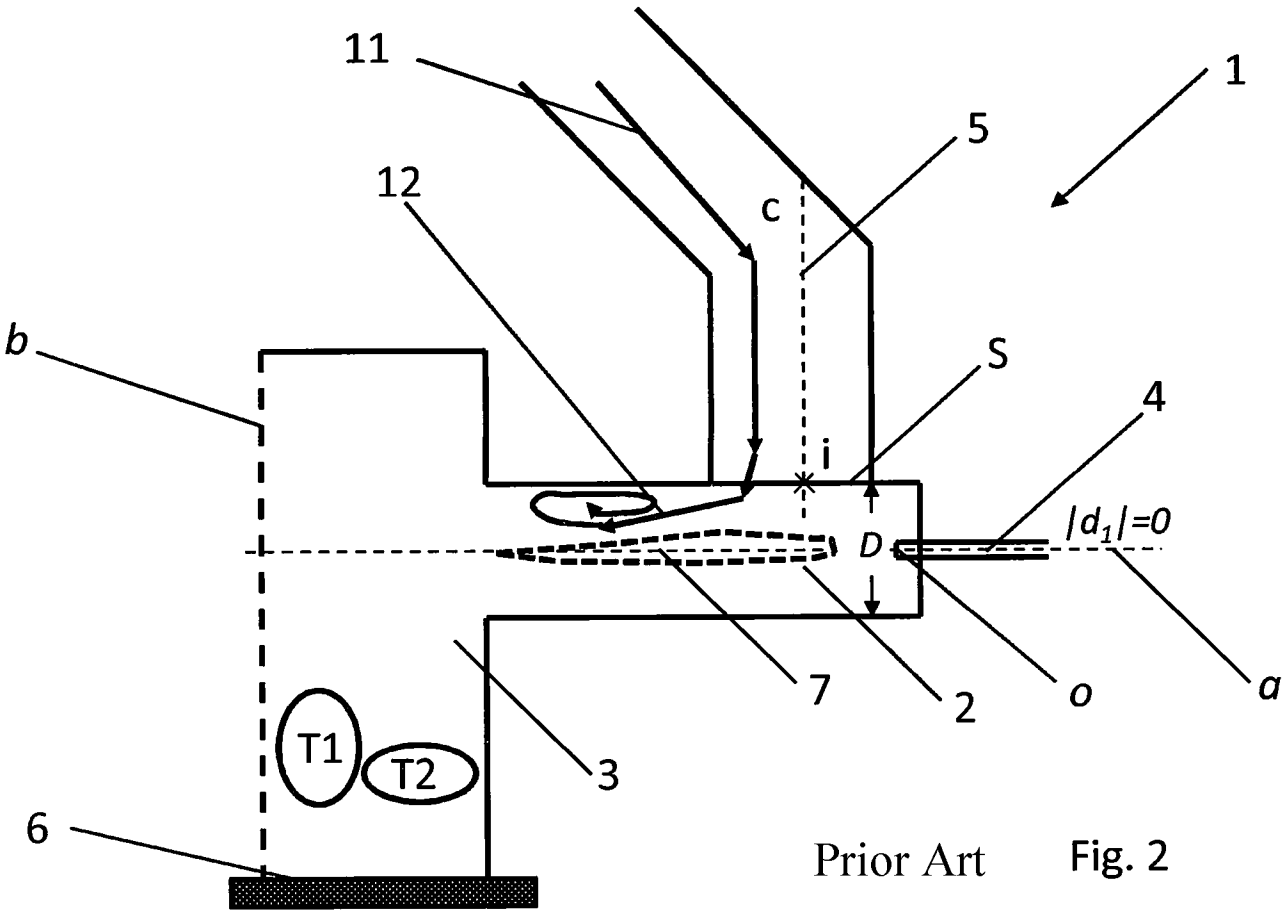

Prior Art Fig. 2

METHOD AND APPARATUS FOR COMBUSTION OF GASEOUS OR LIQUID FUEL

CROSS-REFERENCE TO RELATED APPLICATIONS

This application is a national phase entry under 35 U.S.C. 371 of PCT International Application No. PCT/EP2017/064412 filed Jun. 13, 2017, the disclosure of this application is expressly incorporated herein by reference in its entirety.

The invention relates to a method and its corresponding burner assembly for combustion of gaseous or liquid fuel in a combustion chamber which can have a cylindrical shape with a sectional diameter D whereby gaseous or liquid fuel as well as primary oxidant with a mean velocity of $u_1$ is introduced via a burner lance (including a nozzle head) into the combustion chamber.

Secondary oxidant with a mean velocity of $u_2$ is introduced via a downcomer into the combustion chamber. Certain industrial processes, such as heating a load in an attached furnace, rely on heat produced by the combustion of fuel and oxidant. The fuel is typically natural gas or oil. The oxidant is typically air, vitiated air, oxygen, or air enriched with oxygen. The used burner assemblies typically feature a combustion chamber with at least one burner lance for introducing a gaseous or liquid fuel and primary oxidant and, optionally, a means of supply for secondary oxidant, e.g. a downcomer for secondary air. According to the state of the art the combustion chamber has a horizontal centerline, the downcomer for secondary air has a vertical centerline at the intersection with the combustion chamber, and the burner lance has a horizontal centerline and is located in the centerline of the combustion chamber at the closed end plate of the combustion chamber (see e.g. US 2016/0201904 A1).

Out of the following reasons, a technological challenge in such burner assemblies is a non-uniform temperature profile: At first, a non-uniform temperature profile leads to thermal stress on the wall of the combustion chamber. At second, hot-spots in the flame will increase the formation of NOx. Moreover, a non-uniform temperature profile in the combustion chamber usually leads to a non-uniform temperature profile in the attached furnace where a load is to be treated thermally. This in turn leads to a non-uniform product quality of the heat-treated load.

This last argument should be explained in more detail with regard to the pellet induration in iron ore pelletizing plants: Now, the pellet bed exhibits a non-uniform temperature distribution in horizontal direction, which is due to the local formation of hot zones in the furnace due to convective heat transfer from the flame inside the combustion chamber. Since the flame occupies only a limited space and the surrounding space is occupied by colder secondary air from the downcomer, a huge temperature gradient can be observed along the radius of the combustion chamber at its intersection with the furnace as well as across the width of the furnace itself. With the hot zones being in the center of the furnace, i.e. of the pellet bed, a large variation in the quality of the pellets over the width of the furnace is created.

Typically, a reduction of NOx emissions should be achieved by injecting a mixture of oxidant and fuel. Document U.S. Pat. No. 8,202,470 B2 describes a burner assembly of an indurating furnace with an air passage leading to the heating station. A draft of preheated recirculation air is driven through a passage towards the heating station, and is mixed with fuel gas to form a combustible mixture that ignites in the passage. This is accomplished by injecting the fuel gas into the passage in a stream that does not form a combustible mixture with the preheated recirculation air before entering the passage.

Document WO 2015/018438 A1 teaches a burner assembly wherein combustion air is injected into the combustion chamber such that it passes the burner and is then deflected such that the flow of preheated combustion air and the smaller flows of fuel and primary air are flowing mainly in parallel from the burner to the furnace of the mixer tubes into the combustion chamber to mix with the combustion air.

However, the described solutions do not prevent parts of the combustion chamber suffering from high local thermal stress. Also, these documents are not dealing with the basic effect of a temperature gradient, but try to avoid very high temperature hot-spots as cause for high NOx emissions only.

Therefore, it is the object of the invention to create a more uniform gas temperature in the complete furnace.

This problem is solved with a method according to claim 1.

Such a method comprises the introduction of gaseous or liquid fuel and primary oxidant into a combustion chamber through a burner lance. Each of the fluids in the burner lance, e.g. fuel and primary oxidant, is introduced with a certain velocity, whereby one stream can be faster than the other (at the entry into the combustion chamber). The mean velocity in the burner lance at the entry into the combustion chamber is defined as $u_1$. Further, a secondary oxidant is introduced via a downcomer into the combustion chamber, featuring a mean velocity $u_2$ (at the entry into the combustion chamber). The combustion chamber is typically cylinder-shaped with a sectional diameter D and symmetric to a centerline (it can also have other shapes).

Preferably, $u_1$ is bigger than $u_2$. Most preferably, the ratio $u_1/u_2$ is between 0.1 and 20.0.

It is the essential part of the invention that the burner lance is adjusted in a position p (measured from the tip of the burner lance) such that position p has a distance $|d_1|$ defined as the smallest distance between p and the combustion chamber centerline. Moreover, the distance $|d_1|$ from position p to the intersection point i of the downcomer centerline (at the part of the downcomer next to the intersection area S) and the contact surface of combustion chamber and downcomer is smaller than the distance $|d_c|$. Distance $|d_c|$ is defined as the distance from the intersection of the combustion chamber centerline and the shortest connection between p and the combustion chamber centerline a to the intersection i of the downcomer centerline and the intersection area S of combustion chamber and downcomer.

It is preferred that that the burner lance is arranged in a position p such that position p has a smallest distance $|d_1|$ to the combustion chamber centerline whereby $|d_1|$ defined as $$|d_1| = \left[1 - \left(d \cdot \frac{u_1}{u_2}\right)^{\frac{1}{4}}\right] \cdot \frac{D}{2}.$$

The mean velocity $u_1$ is defined as $$u_1 = \frac{\sum_{i=1}^{n} v_i^2 \cdot \rho_i \cdot A_i}{\dot{m}_{ges}},$$

whereby $v_i$ is the velocity of each separate fluid in the burner lance, $\rho_i$ is the density of each separate fluid in the burner lance, $A_i$ is the cross-section for the flow of each separate fluid in the burner lance at the entry of the burner lance into the combustion chamber and $\dot{m}_{ges}$ is the overall mass flow in the burner lance. Separate fluids in the burner lance can for example be: fuel, primary air, cooling air, shield air or a mixture of primary air and fuel.

Preferably, position p has a smallest distance $|d_1|$, whereby $d_1$ has a positive sign, to the combustion chamber centerline with $$d_1 = \left[1 - \left(d \cdot \frac{u_1}{u_2}\right)^{\frac{1}{4}}\right] \cdot \frac{D}{2},$$

whereby d is in the range of 0.05 to 0.15.

Computational fluid dynamics (CFD) simulations have shown that by repositioning the lance into the position p according to the invention, a temperature gradient ent $|\Delta t|$ with $|\Delta T| = T_{pelletbedsurface,max} - T_{pelletbedsurface,min}$ of less than 10K was found. This is much lower than in the state of the art, where $|\Delta T|$ typically amounts to 40K. The reason for the improvement is the interaction of the flame and the recirculation zone in the combustion chamber.

By positioning the burner lance to a higher position p relative to the combustion chamber centerline in the sense that the distance between the lower end of the downcomer and the centerline of the burner lance is reduced, a flame deflection can be induced. This deflection is caused in a recirculation zone due to the preheated secondary oxidant redirection from the downcomer to the combustion chamber. The flame which is placed at a slightly higher location in accordance with the invention due to the repositioned burner lance gets sucked in by the recirculation zone and finally deflected. This deflection in turn modifies the angle under which the resulting hot flue gas meets the flue gas from the oppositely placed combustion chamber. According to the state of the art the flow path of the hottest part of the flue gas in the furnace is directed downwards, according to the invention it is directed upwards.

A further benefit of the invention is a temperature reduction at the hottest part of the combustion chamber wall: At standard configurations according to the state of the art, higher temperatures at the combustion chamber bottom wall are found, caused by a certain flame deflection inside the combustion chamber towards its bottom. The configuration according to the invention leads to a significantly bigger flame distance to the bottom wall, and thus the bottom wall temperature is reduced. This reduces the risk of thermal damages and may even allow for an increase of the burner capacity.

The invention claims the new burner lance placement with the non-dimensional factor d being in a range of 0.05 to 0.15, preferably in the range of 0.075 to 0.125 and most preferably in the range of 0.09 to 0.11. For a typical use of burner assembly according to the state of the art with a burner lance in the centerline of the combustion chamber the factor d would be in the range from 0.2 to 0.3.

If the factor d exceeds 0.15, then the distance between flame and recirculation zone is too big, consequently no flame deflection takes place. If the factor d is lower than 0.05, then the distance between flame and recirculation zone is too small, consequently the gas temperature in the recirculation zone increases strongly. Consequently, the upper wall temperature rises what may cause thermal damages.

It is preferred that the mean velocity $u_1$ is less than 200 m/s, preferably in a range between 70 and 140 m/s. Thereby, a reasonable pressure drop in the lance or the lance head is achieved as well as lower NOx formation.

Moreover, according to the invention it is preferred to introduce the secondary oxidant into the combustion chamber with a mean velocity $u_2$ between 10 and 35 m/s to ensure a good distribution of the fuel.

In principal, each gas with any oxygen content can be used as an oxidant. However, air or air enriched with oxygen is most common due to cost reasons. The following description relates to air as the primary and secondary oxidant.

Another relevant parameter is the total air ratio λ with $$\lambda = \frac{\dot{m}_{air}}{\dot{m}_{stoich}}$$

whereby $\dot{m}_{air}$ is the overall massflow of injected air (primary and secondary air) and $\dot{m}_{stoich}$ is the air massflow needed for a stoichiometric reaction with the injected fuel. Preferably, λ is in the range of 1.2 to 12, preferably 2 to 6.5.

Out of the same reasons, the primary air ratio $\lambda_{prim}$ with $$\lambda_{prim} = \frac{\dot{m}_{air\text{-}prim}}{\dot{m}_{stoich}}$$

is in the range of 0.05 to 2 whereby $\dot{m}_{air\text{-}prim}$ is the mass flow of injected primary air.

A typical burner lance has a capacity in the range of 2 and 6 MW. This enables the use in typical industrial furnaces.

The invention also covers a burner assembly with the features of claim 10.

Such a burner assembly comprises a cylinder-shaped, rectangular or otherwise shaped combustion chamber with a centerline and a hydraulic diameter D. At least one burner lance is used as a supply for gaseous or liquid fuel and primary oxidant with a mean velocity $u_1$ and one downcomer as a supply for secondary oxidant with a mean velocity $u_2$.

It is the essential part of the invention that the burner lance is adjusted in a position p (measured from the tip of the burner lance) such that position p has a distance $|d_1|$ defined as the smallest distance between p and the combustion chamber centerline. Moreover, the distance $|d_1|$ from position p to the intersection of the downcomer centerline and the intersection area S of combustion chamber and downcomer is smaller than the distance $|d_c|$. Distance $|d_c|$ is defined as the distance from the intersection of the combustion centerline and the shortest connection between p and the combustion chamber centerline a to the intersection point i of the downcomer centerline and the intersection area S of combustion chamber and downcomer.

It is preferred that that the burner lance is arranged in a position p such that position p has a smallest distance $|d_1|$ to the combustion chamber centerline whereby $|d_1|$ defined as $$|d_1| = \left[1 - \left(d \cdot \frac{u_1}{u_2}\right)^{\frac{1}{4}}\right] \cdot \frac{D}{2}.$$

The mean velocity $u_1$ is defined as $$u_1 = \frac{\sum_{i=1}^{n} v_i^2 \cdot \rho_i \cdot A_i}{\dot{m}_{ges}},$$

whereby $v_i$ is the velocity of each separate fluid in the burner lance, $\rho_i$ is the density of each separate fluid in the burner lance, $A_i$ is the cross-section for the flow of each separate fluid in the burner lance at the entry of the burner lance into the combustion chamber and $\dot{m}_{ges}$ is the overall mass flow in the burner lance.

By including an inclination angle α of the burner lance to the combustion chamber centerline, the positive effect of the recirculation zone on the flame behavior and on the temperature distribution in the furnace can be amplified. This inclination angle α should not exceed values larger than 12°, preferably it should be smaller than 10°, since otherwise the flame would get in direct contact with the upper combustion chamber wall. In the most preferred case the inclination angle α is chosen in such a way that the burner lance, respectively nozzle head is pointing into the direction of the downcomer.

Typically, the combustion chamber diameter D lies between 0.5 and 1.8 m, so it fits well to industrial furnaces.

Most preferred at least two, preferably arranged symmetrically, burner assemblies are designed according to any of claims 11 to 13 in a pellet induration furnace. By inducing a swirl in the furnace, mixing can be enhanced and therefore even more homogeneous temperature profiles can be obtained. This in turn improves the uniformity of the pellet quality. The swirl is induced by a modified impingement angle of the hot combustion gases stemming from two oppositely placed combustion chambers. The modified impingement angle itself is a result of a higher situated burner lance (fuel and primary oxidant), which leads to a flame bending due to partial interference of the flame with the recirculation zone placed on the upper combustion chamber wall.

The hot gases from the flame are redirected several times due to symmetry planes to the next burner in one row as well as impingement on the furnace walls. This creates a huge swirl system leading to enhanced flow mixing and finally to a uniform temperature distribution of the flue gas above the pellet bed. The recirculation zone, which deflects the flame, does thereby not get heated up significantly by hot flame gases.

The hot zone can hereby be moved from the symmetry plane of the furnace towards the side walls of the furnace. This is of advantage, because the heat losses are higher in the vicinity of the furnace side walls as compared to the symmetry plane of the furnace.

The invented new position of the burner lance can be easily realized by installing appropriate burner assemblies, which is why also existing plants can be optimized. The implementation of this invention is especially much more economic than other possible approaches in existing plants, because the arrangement of the downcomer can remain as it is according to the state of the art, i.e. with a vertical centerline in its lower portion. This typically results in a 90° angle between the centerline of the lower portion of the downcomer and the combustion chamber centerline, because typically the combustion chamber has a horizontal centerline.

The lower part of the downcomer itself does not have to align with the combustion chamber with an angle of 90° but can be also inclined, leading to angles smaller or larger than 90°. The exact value of the inclination does not matter, as the recirculation zone will be created under a wide range of possible inclination angles. However, changing the angle of the downcomer in an existing pellet induration furnace is hardly possible because of space and cost limitations.

The invention will now be described in more detail on the basis of the following description of preferred embodiments and the drawings. All features described or illustrated form the subject matter of the invention, independent of their combination in the claims or their back reference. In detail, the state of the art design will be compared to the modified design by means of drawings explaining the modified flame behavior, the swirling effect as well as the development of hot and cold zones at the oven outlet.

Figure 3:
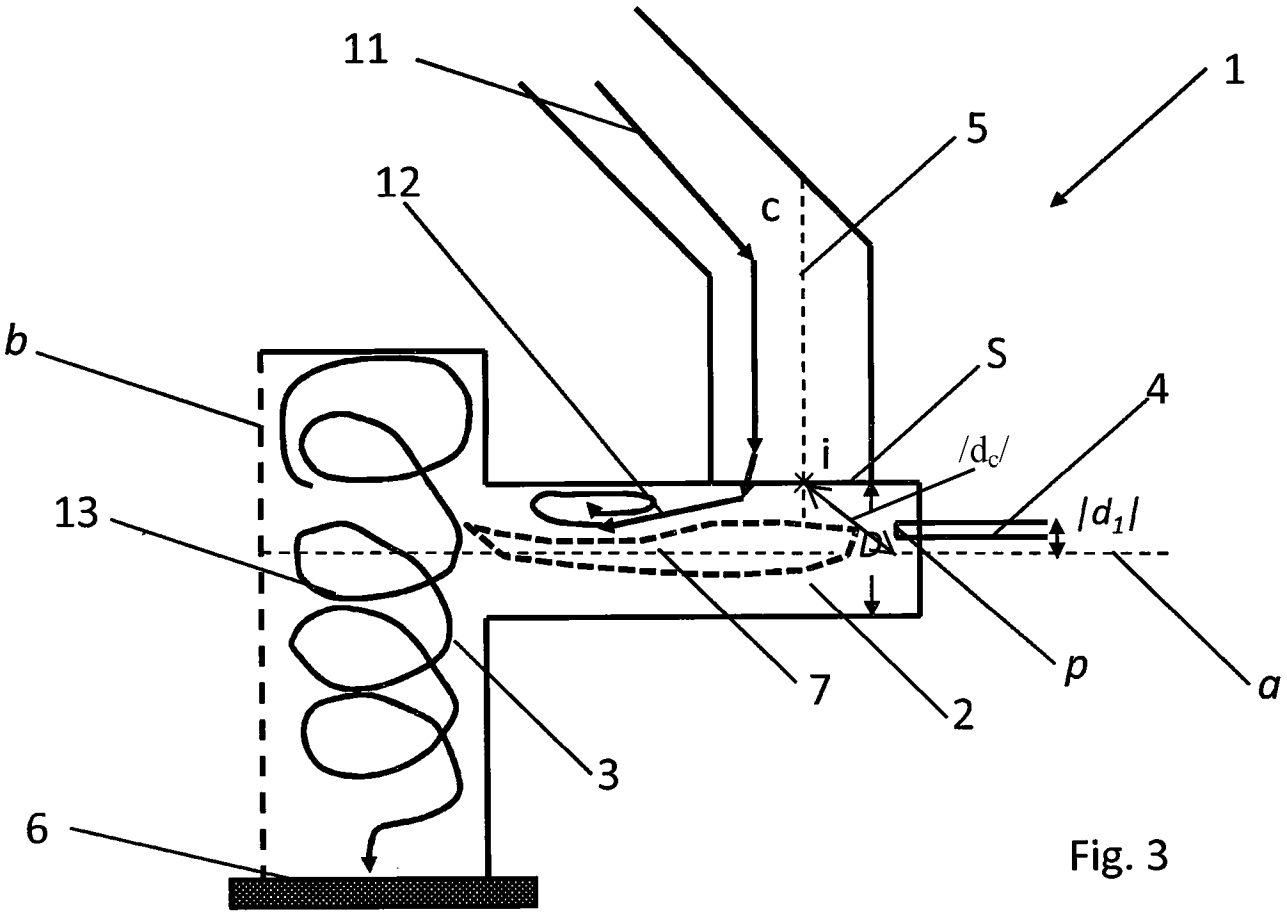
Figure 4:
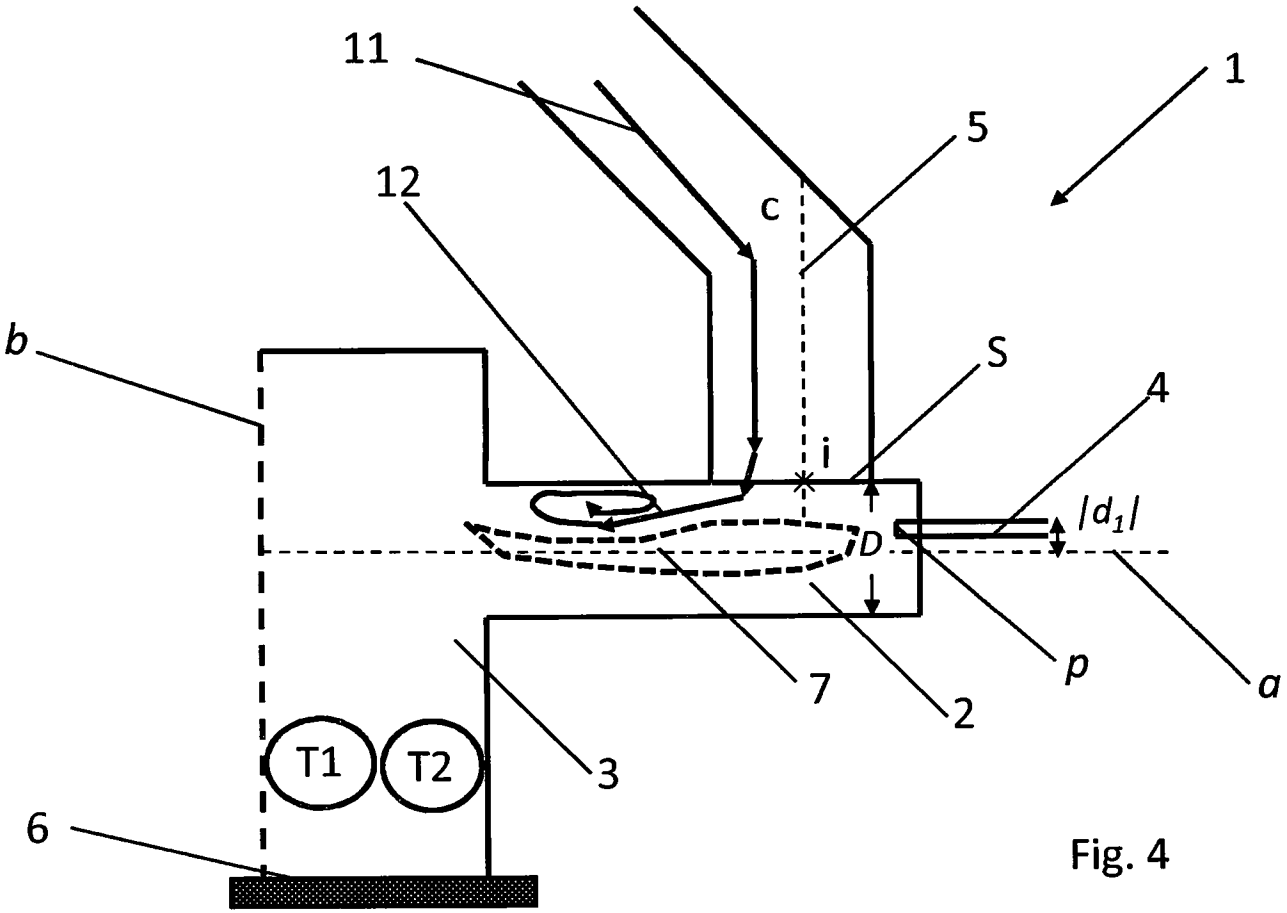
Figure 5:
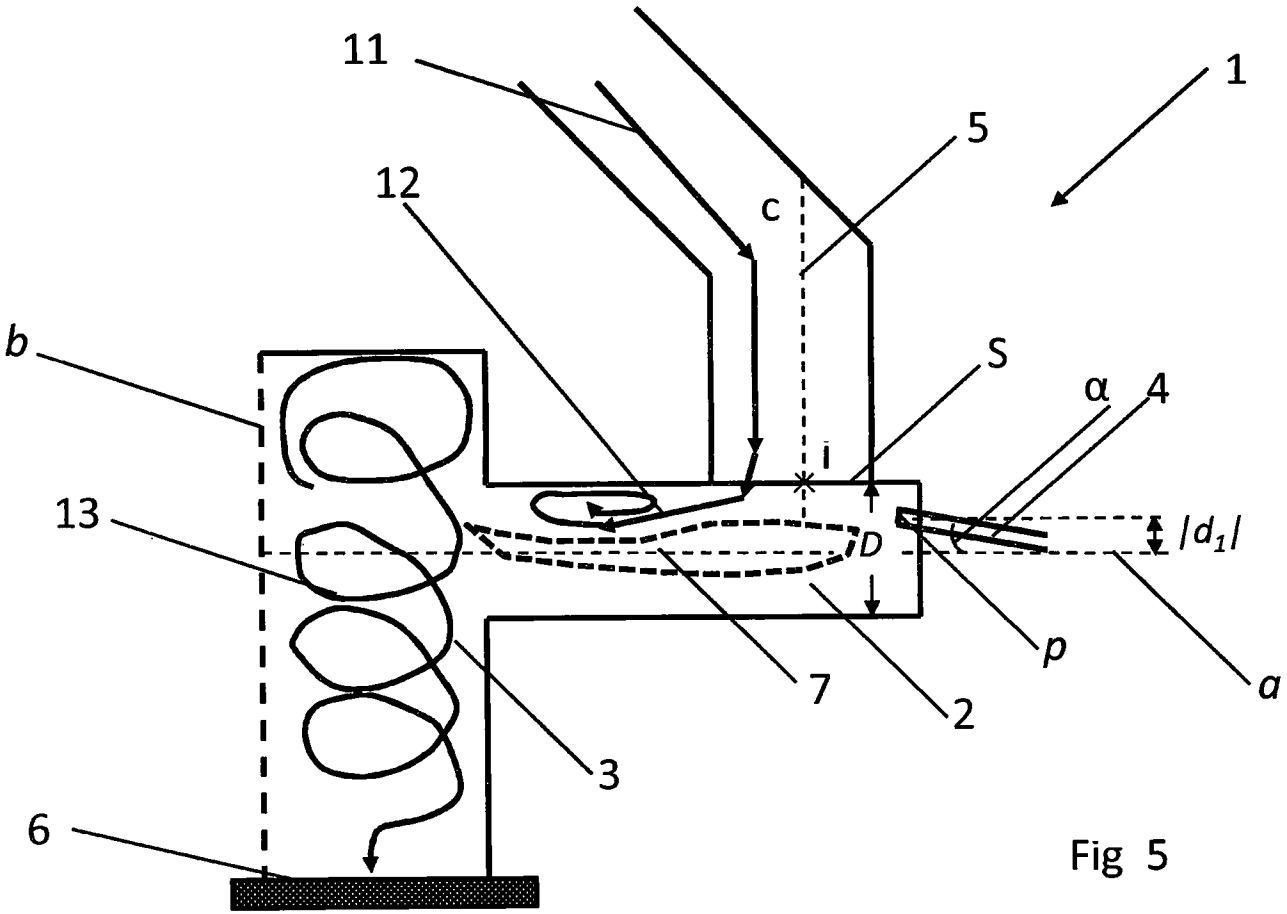
Figure 6:
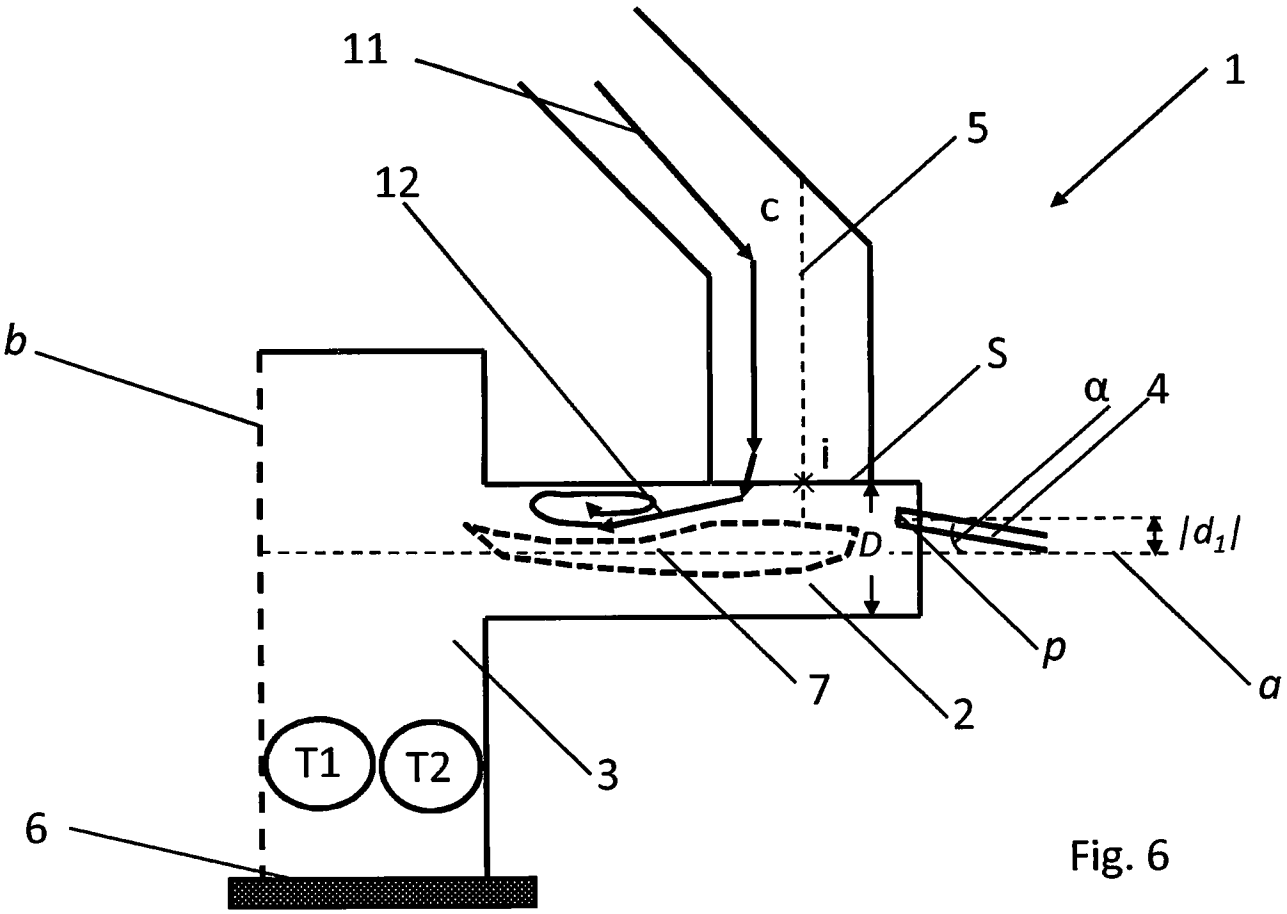

In the drawings:

FIG. 1 shows a design of a pellet induration furnace according to the state of the art focusing on flow conditions, FIG. 2 shows a design of a pellet induration furnace according to the state of the art focusing on the temperature profile in the furnace, FIG. 3 shows a first design of a pellet induration furnace according to the invention focusing on flow conditions, FIG. 4 shows a first design of a pellet induration furnace according to the invention focusing on the temperature profile in the furnace, FIG. 5 shows a second design of a pellet induration furnace according to the invention focusing on flow conditions, FIG. 6 shows a second design of a pellet induration furnace according to the invention focusing on the temperature profile in the furnace.

FIG. 1 shows a typical design of a pellet induration furnace, especially of an iron ore pellet induration furnace, according to the state of the art. A burner assembly 1 according to the state of the art, e.g. US 2016/0201904 A1 is shown in a sectional view.

The burner assembly 1 features a combustion chamber 2 being cylindrical-shaped with a sectional diameter D, and, therefore, being symmetrical around its centerline a. The combustion chamber 2 works as a flame-reaction space.

On the left side of FIG. 1, the combustion chamber 2 opens into a furnace 3. On the opposite side, a burner lance 4 is positioned at position o. As FIG. 1 depicts the situation known from the state of the art, position o is located on the centerline a, resulting in the distance $|d_1|$ being equal to 0.

Furnace 3 is designed such that two burner assemblies, on opposite positions are used, which is indicted by the symmetry plane b.

Via the burner lance 4, liquid or gaseous fuel as well as a primary oxidant, preferably air, are injected into the combustion chamber 2. Typically, also a control unit or equipment (not shown) is provided for controlling the supplies of fuel and primary air into the combustion chamber.

The majority of oxidant is typically injected via a downcomer 5 through which secondary oxidant, e.g. preheated air, is flowing downwards into the combustion chamber 2. The lower part of the downcomer features a center line c next to its intersection area S with the combustion chamber 2. The intersection of the center line c and the intersection area S is defined as position. As shown via arrows 11, the secondary oxidant is passing the burner lance 4 and the flame 7 before it is creating a recirculation zone 12.

Inside the furnace 3, the flue gas coming from the combustion chamber 2 is flowing downwards (shown via arrows 13), e.g. Into the pellet bed 6.

In FIG. 2, basically the same structure is used. However, instead of gas stream lines, FIG. 2 shows a simplified temperature profile in the furnace, e.g. above a pellet bed 6. Thereby, $T_1$ indicates a hot zone while $T_2$ Indicates a colder zone. Typically a difference of at least 40 K is found between these two zones.

In comparison, FIG. 3 shows the same burner and furnace assembly according to the invention. As described, the burner lance 4 is positioned in the position p with its smallest distance $|d_1|$ to the centerline a of the combustion chamber 2, where $d_1$ is defined as $$d_1 = \left[1 - \left(d \cdot \frac{u_1}{u_2}\right)^{\frac{1}{4}}\right] \cdot \frac{D}{2},$$

whereby d is in the range of 0.05 to 0.15. In case $d_1$ ends up with a positive sign, position p is always closer to the downcomer than in the case it ends up with a negative sign.

As shown in FIG. 3, the flame 7 interacts with the recirculation zone 12, so highly turbulent flow conditions are found in furnace 3.

As a result, a better mixing of the gas flow is achieved inside the furnace 3, which is why FIG. 4 shows a more homogenous temperature profile, symbolized by a nearly identical size of $T_1$ (hot zone) and $T_2$ (colder zone) with a difference in CFD simulations of maximum 10 K between $T_1$ and $T_2$.

FIGS. 5 and 6 correspond to FIGS. 3 and 4, but shows an inclined burner lance. The inclination angle $\alpha$ is measured between the centerline a of the combustion chamber and the centerline of the burner lance 4.

REFERENCE NUMBERS

1 burner assembly
2 combustion chamber
3 furnace
4 burner lance
5 downcomer
6 pellet bed
7 flame
11 flow of the secondary oxidant
12 recirculation zone
13 flow of the gas in the furnace
$T_1$ Temperature in the hot zone
$T_2$ Temperature in the colder zone
a centerline of the combustion chamber
$\alpha$ inclination angle
b symmetry plane of the furnace
c centerline of the downcomer (next to the intersection area S)
D sectional diameter of the combustion chamber
d dimensionless factor
$|d_1|$ smallest distance of position p to the combustion chamber centerline a
i intersection of the downcomer centerline c and the intersection area S of combustion chamber and downcomer
o position of the burner lance according to the state of the art
p position of the burner lance according to the invention
S intersection area of combustion chamber (2) and downcomer (5)
$u_1$ mean velocity in the burner lance at the entry to the combustion chamber
$u_2$ mean velocity of the secondary oxidant in the downcomer

The invention claimed is:

1. A method for combustion of gaseous or liquid fuel in a combustion chamber with a hydraulic diameter D, whereby the fuel as well as the primary oxidant are introduced via a burner lance into the combustion chamber, whereby fuel and primary oxidant have a certain mean velocity $u_1$ at the entry from the burner lance into the combustion chamber, whereby the mean velocity $u_1$ is defined as $$u_1 = \frac{\sum_{i=1}^{n} v_i^2 \cdot \rho_i \cdot A_i}{\dot{m}_{ges}},$$

whereby $v_i$ is the velocity of each separate fluid in the burner lance, $\rho_i$ is the density of each separate fluid in the burner lance, $A_i$ is the cross-section for the flow of each separate fluid in the burner lance at the entry of the burner lance into the combustion chamber and $\dot{m}_{ges}$ is the overall mass flow in the burner lance and whereby a secondary oxidant with a mean velocity of $u_2$ is introduced via a downcomer into the combustion chamber, wherein the burner lance is arranged such that a distance $|d_1|$ defined as the smallest distance between a tip p of the burner lance and a combustion chamber centerline a is smaller than a distance $|d_c|$ from an intersection point of the combustion chamber centerline a and a shortest line connecting the tip p of the burner lance and the combustion chamber centerline a to the intersection point i of the downcomer centerline c and an intersection area S of combustion chamber and downcomer, whereby the value of $|d_1|$ is such that $$|d_1| = \left[1 - \left(d \cdot \frac{u_1}{u_2}\right)^{\frac{1}{4}}\right] \cdot \frac{D}{2}$$

and that d is in the range of 0.05 to 0.15, wherein the mean velocity $u_1$ is from 70 m/s to 140 m/s and the mean velocity $u_2$ is from 10 m/s to 35 m/s.

2. The method according to claim 1, wherein the d is in the range of 0.09 to 0.11.

3. The method according to claim 1, wherein the primary and/or the secondary oxidant is air.

4. The method according to claim 1, wherein the total air ratio $\lambda$ with $$\lambda = \frac{\dot{m}_{air}}{\dot{m}_{stoich}}$$

is in the range of 1.2 and 12.0.

5. The method according to claim 1, wherein the primary air ratio $\lambda_{prim}$ with $$\lambda_{prim} = \frac{\dot{m}_{air\text{-}prim}}{\dot{m}_{stoich}}$$

is in the range of 0.05 and 2.0.

6. The method according to claim 1, wherein the burner lance has a fuel capacity in the range of 2 and 6 MW.

7. A burner assembly comprising a combustion chamber with a centerline a, a hydraulic diameter D, a burner lance to introduce fuel and primary into the combustion chamber, whereby the mean velocity $u_1$ is defined as $$u_1 = \frac{\sum_{i=1}^{n} v_i^2 \cdot \rho_i \cdot A_i}{\dot{m}_{ges}},$$

whereby $v_i$ is the velocity of each separate fluid in the burner lance, $\rho_i$ is the density of each separate fluid in the burner lance, $A_i$ is the cross-section for the flow of each separate fluid in the burner lance at the entry of the burner lance into the combustion chamber and $\dot{m}_{ges}$ is the overall mass flow in the burner lance, whereby the burner assembly adapted such that fuel and primary oxidant have a certain mean velocity $u_1$ at the entry from the burner lance into the combustion chamber, measured from a tip p of the burner lance and a downcomer adapted to introduce a secondary oxidant with a mean velocity of $u_2$ into the combustion chamber, wherein the burner lance is arranged such that a distance $|d_1|$ defined as the smallest distance between the tip p of the burner lance and a combustion chamber centerline (a) is smaller than a distance $|d_c|$ from an intersection point of the combustion centerline (a) and a shortest line connecting the tip p of the burner lance and the combustion chamber centerline (a) to an intersection point (i) of the downcomer centerline (c) and an intersection area (S) of the combustion chamber and downcomer, whereby the value $|d_1|$ is such that $$|d_1| = \left[1 - \left(d \cdot \frac{u_1}{u_2}\right)^{\frac{1}{4}}\right] \cdot \frac{D}{2}$$

and that d is in the range of 0.05 to 0.15, wherein the mean velocity $u_1$ is from 70 m/s to 140 m/s and the mean velocity $u_2$ is from 10 m/s to 35 m/s.

8. The burner assembly according to claim 7, wherein the burner lance is arranged at an angle $\alpha$ from greater than 0° to 12° to the combustion chamber centerline a.

9. The burner assembly according to claim 7, wherein the burner lance points towards the downcomer.

10. The burner assembly according claim 7, wherein the combustion chamber's diameter D lies between 0.5 and 1.8 m.

11. The method according to claim 1, wherein the entire tip p of the burner lance is offset from the combustion chamber centerline a and positioned between the combustion centerline a and the intersection area S.

* * * * *